United States Patent [19]

Patterson

[11] 4,176,350

[45] Nov. 27, 1979

[54] INDICATOR TO SHOW WHETHER A SWITCH HAS OPENED

[76] Inventor: Billy J. Patterson, 6326 Hanley, Corpus Christi, Tex. 78412

[21] Appl. No.: 798,108

[22] Filed: May 18, 1977

[51] Int. Cl.[2] ..... G08B 21/00

[52] U.S. Cl. ..... 340/644; 318/490; 361/23; 340/639; 340/648; 340/652

[58] Field of Search ..... 340/250, 248 R, 282, 340/249, 253 E, 520, 652, 635, 638, 639, 644, 641, 648; 318/490; 361/26, 32, 74, 23; 73/363.5, 378.3; 337/79, 332; 116/221

[56] References Cited

U.S. PATENT DOCUMENTS

| | | | |
|---|---|---|---|
| 1,893,305 | 1/1933 | Rentschler | 337/242 X |
| 2,007,313 | 7/1935 | Sherwood | 337/243 |
| 2,115,428 | 4/1938 | Quisling | 337/265 |
| 2,488,622 | 11/1949 | Giorgianni | 340/550 X |
| 2,576,574 | 11/1951 | Cochran | 318/490 X |
| 2,736,009 | 2/1956 | Barnickel | 318/490 X |
| 2,930,961 | 3/1960 | Lezan | 340/250 X |
| 3,041,427 | 6/1962 | Waller et al. | 337/243 |
| 3,462,754 | 8/1969 | Kelley | 340/253 E |
| 3,889,248 | 6/1975 | Ritter | 340/249 |

*Primary Examiner*—John W. Caldwell, Sr.
*Assistant Examiner*—Daniel Myer
*Attorney, Agent, or Firm*—G. Turner Moller

[57] ABSTRACT

An indicator is provided for use in a machine, such as an escalator, having a multiplicity of normally closed switches which act to turn off the machine in the event of a machine malfunction, unsafe condition or an inappropriate switch placement. The switches are capable of reclosing but not restarting the machine. The indicator shows which of the switches caused the machine to stop thereby performing a troubleshooting function to allow a repairman to determine immediately which of the various machine systems caused the malfunction or unsafe condition.

18 Claims, 8 Drawing Figures

INDICATOR TO SHOW WHETHER A SWITCH HAS OPENED

This invention relates to a troubleshooting indicator system incorporated in a machine having a multiplicity of normally closed switches which monitor the operation of the machine and open in response to machine malfunction, an unsafe condition or an inappropriate switch placement to shut off the machine. The switches normally reclose or are capable of reclosing but the machine is not typically restarted by reclosing the switches. The indicator system acts to designate which of the switches opened thereby pinpointing which machine system caused the stoppage.

Although the indicating system of this invention has particular application to elevators and escalators and is hereinafter described in connection with an escalator, it has application to any machine having a multiplicity of normally closed switches which open in response to an event for shutting off the machine where it is desirable to later determine which of the switches caused the machine to stop. Other exemplary machines in which the indicator system of this invention has application are computers, copy machines and the like.

A typical escalator, for example, has eighteen normally closed switches which monitor machine operation. There are four switches monitoring cover plate contact and four switches monitoring hand rail lead in. There are four switches monitoring the skirt guard. There are two switches monitoring chain tension. There are four switches monitoring the comb plate. When any one of these switches is opened, due to machine malfunction, an unsafe condition or an inappropriate switch placement, the escalator drive motor is deenergized and the escalator stops. Because the monitoring switch is typically in a relay circuit, the drive motor is not reenergized when the monitoring switch recloses. When a repairman arrives at the escalator installation, the event that caused the switch to open typically has passed and the switch has reclosed. There is accordingly no convenient technique for isolating or pinpointing the cause of machine stoppage. The repairman accordingly institutes rather elaborate troubleshooting techniques in an attempt to isolate the difficulty. These troubleshooting techniques are often long and involved. It will suffice to say that, in many circumstances, once the difficulty has been isolated, the repair is simple, quick and straightforward.

It is accordingly not surprising that attempts have been made to provide an indicator for escalators and the like which have a troubleshooting function to isolate or pinpoint the cause of machine stoppage. The only device presently known to be commercially available is of the annunciator or flag type. Systems of this type include an indicator for each switch comprising a coil energized when the switch opens, a flag indicator which is movable between hidden and displayed positions and a linkage which acts to move the flag from the hidden position to the displayed position and to hold the flag in the displayed position when the switch recloses. Because each individual indicator is somewhat complex and because each escalator typically requires eighteen independent indicators, the hardware costs of such an approach is substantial. In addition, the installation costs of annunciator type indicators is substantial for all of the wiring, connector and labor charges.

The telephone industry uses an indicator in conjunction with circuit protecting fuses. There are typically a large number of circuit protecting fuses in a room. The circuit protecting fuse typically incorporates a moderately sized copper strap housed in an opaque fiber housing. In parallel with such a circuit protecting fuse is a second or indicating fuse having a substantially lower amperage capacity. When the circuit protecting fuse blows, the indicating fuse blows immediately thereafter and closes a pair of contacts energizing an audible alarm. The indicating fuse also includes a movable flag member so that the repairman can locate the circuit protecting fuse that has blown. The problem posed in the telephone industry is different from that in the machine environment to which this invention relates for the following reasons. If the machine switch stays open, as a fuse would, it is a simple matter to find the open switch by the use of a bulb having leads thereon. The repairman merely touches the leads to the connector posts associated with each switch on the control panel. If the bulb does not light, the jumped switch is not the open switch. If the bulb lights, the jumped switch is the open switch.

Another device of interest is shown in U.S. Pat. No. 3,469,217 and comprises a bulb and a resistor in parallel with a normally closed switch. When the switch opens, the bulb is lit. A conductive path around the open switch is accordingly established. When the switch closes, the bulb is deenergized. Because the machine switches to which this invention is applicable normally reclose, this approach is unsuitable for two reasons. First, this approach would not drop the motor relay and would not shut off the motor. Accordingly, this approach would be worse than useless. Second, this approach would not provide an indication when the switch recloses, as it normally does.

The present invention overcomes the foregoing and other drawbacks of the prior art and provides a novel and improved technique for troubleshooting a machine having a multiplicity of normally closed switches.

In accordance with one approach of this invention, the normally closed switches are of the single pole, double throw type wherein all of the switches are in series. Each switch accordingly comprises a common or first terminal, a second terminal, a switch element normally closing the common and second terminals and a third normally unused terminal positioned in the path of switch opening movement. Means including an electrically conductive element is placed in circuit with the third switch contact and is rendered non-conductive and distinctly different in appearance upon opening of its associated switch and upon the passage of electricity therethrough. In this approach of the invention, the conductive element can be rendered non-conductive in response to excess current, such as a fuse or many bulbs, or rendered non-conductive in response to excess voltage, such as some types of bulbs. Immediately after the single pole, double throw switch opens and deenergizes a relay delivering power to the drive motor, a circuit is closed through the conductive element to ground. Because the current or voltage present in the line is sufficient to blow the conductive element, the conductive element is destroyed or interrupted and is made distinctly different in appearance. When a repairman arrives at the installation, inspection of the trouble-shooting panel will reveal which conductive element has blown and consequently pinpoint the machine system that has malfunctioned to cause stoppage. The repairman is then able to omit the elaborate troubleshooting techniques otherwise necessary to isolate the cause of stoppage and proceed immediately to repair the machine.

In accordance with another approach of this invention, a conductive element is placed in parallel with its associated switch. When the switch begins to open, electricity in the line begins to pass through both the switch and the conductive element which may either be voltage responsive or current responsive. When the switch is fully open, the electricity in the circuit is sufficient to overload the conductive element and cause it to fail or otherwise become non-conductive and distinctly different in appearance from its original condition. Accordingly, when a repairman arrives at the installation, inspection of the troubleshooting panel reveals which switch opened, thereby pinpointing the machine difficulty.

Any fuse or bulb becomes distinctly different in appearance when it fails, if for no reason other than the filament is burned into two pieces. While this type difference is technically satisfactory, it is preferred that the fuse or bulb provide another appearance distinction when blown. For example, it is preferred to use fuses which discolor a member inside an envelope or bulbs which crack, craze, bulge or otherwise affect the surrounding envelope to be dramatically different in appearance.

It is an object of this invention to provide an improved mechanism for troubleshooting machines having a multiplicity of normally closed switches which monitor machine function.

Another object of this invention is to provide an improved machine having a multiplicity of normally closed switches for monitoring the operation of the machine including means for indicating which of the multiplicity of switches has opened.

Other objects and a fuller understanding of the invention may be had by referring to the following description and claims taken in conjunction with the accompanying drawings.

Figure 1:
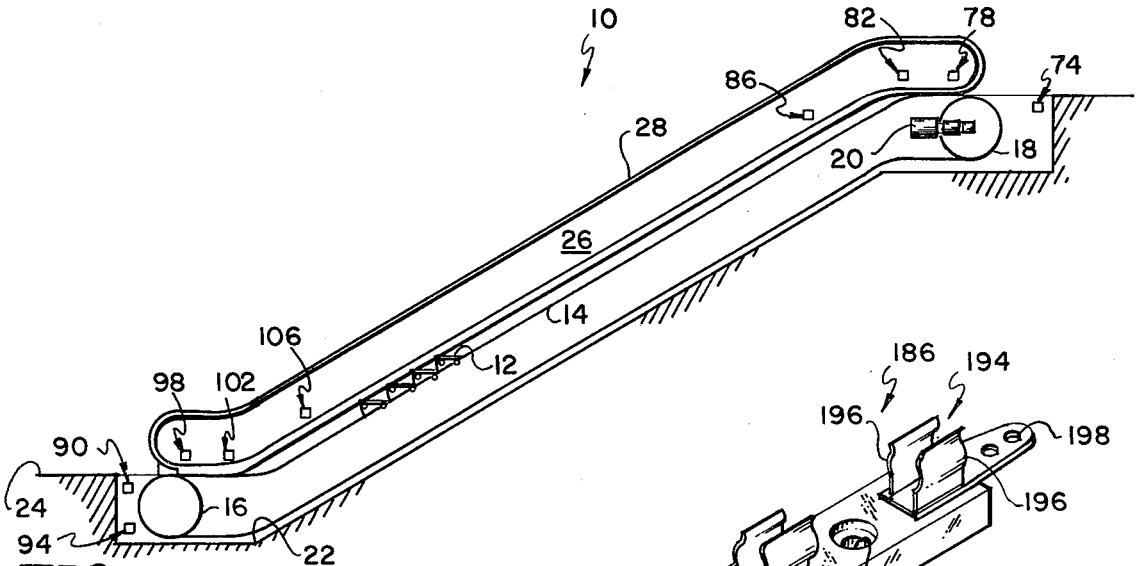
FIG. 1 is a simplified longitudinal cross-sectional view of one type machine for which the troubleshooting technique of the invention has application.

Referring to FIG. 1, there is illustrated an escalator 10 comprising an endless stair 12 carried by a pair of chains 14 wrapped around a pair of idler rollers or sprockets 16 and wrapped about a pair of bull sprockets 18 driven in any suitable manner by an electric motor 20. These operating mechanisms of the escalator 10 are housed in a well 22 below an arbitrary ground surface 24. A pair of upstanding housings 26 each carry a movable handrail 28. The delivery of suitable power to the electric motor 20 drives the bull sprocket 18 to advance the endless stair 12 in either an up or a down direction depending on the drive direction of the motor 20. As will be pointed out more fully hereinafter and as will be apparent to those of ordinary skill in the art, a multiplicity of switches monitor the operation of the escalator 10 and act to turn off the electric motor 20 in the event of a machine malfunction, an unsafe condition or inappropriate switch placement.

Figure 2:
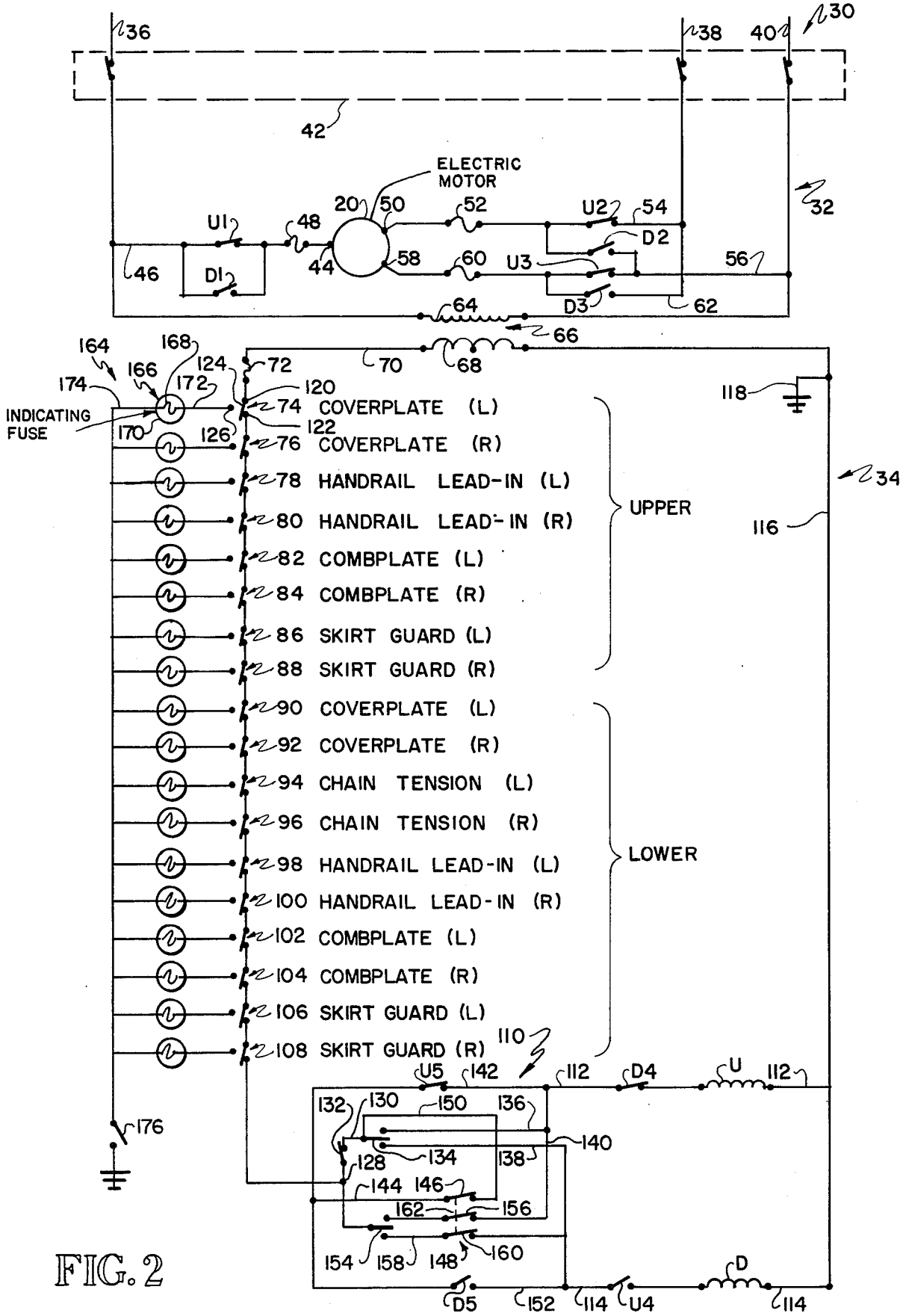
FIG. 2 is a schematic circuit diagram illustrating one technique for powering the escalator of FIG. 1.

Referring to FIG. 2, there is illustrated a conventional power circuit 30 for energizing the motor 20 which comprises a high voltage or power subcircuit 32 and a low voltage or relay subcircuit 34. Although the circuit 30 may be of any suitable type, it is illustrated as typical of the designs of the Montgomery Elevator Company of Moline, Ill.

The high voltage subcircuit 32 comprises first, second and third leads 36, 38, 40 connected to a source of three phase alternating current. The leads 36, 38, 40 extend on opposite sides of a circuit breaker 42 having a pair of switch contacts and switch element for each of the leads. The lead 36 is connected to one terminal 44 of the motor 20 through a wire 46, a fuse 48 and a pair of relay switch assemblies U1, D1 placed in parallel. Another terminal 50 of the motor 20 and a fuse 52 are wired for connection to either of the leads 38, 40 through a pair of wires 54, 56 having therein a relay switch assembly U2, D2. The third motor terminal 58 and a fuse 60 are wired for connection to the lead 40 through a relay switch assembly U3 and the lead 56 and is also wired for connection to the lead 38 through a wire 62 and a relay switch assembly D3. The leads 36, 40 are connected through a high voltage winding 64 of a transformer 66 providing a coupling between the subcircuits 32, 34. As will be more fully apparent hereinafter, the relay switch assemblies U1, U2, U3 are manipulated or moved by a relay coil U to energize the motor 20 to drive the endless stair 12 in an up direction. Similarly, the relay switch assemblies D1, D2, D3 are manipulated by a relay coil D to energize the motor 20 to drive the endless stair 12 in a down direction.

The low voltage or relay subcircuit 34 comprises a winding 68 of the transformer 66 having a lead 70 extending from one end terminal to a fuse 72 and a multiplicity of microswitches 74–108 wired in series with a motor starting switch network 110. The switch network 110 is wired to a lead 112 having therein a normally closed switch assembly D4 and the relay coil U in parallel with a lead 114 having therein a normally closed relay switch assembly U4 and the relay coil D. The leads 112, 114 are connected to a common wire 116 having a ground connection 118 therein connected to the opposite end terminal of the low voltage winding 68.

Figure 5:
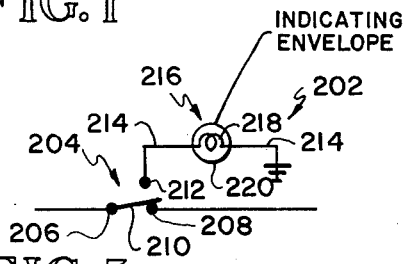
FIGS. 5–8 schematically illustrate other embodiments of the individual indicators of this invention.
Figure 6:
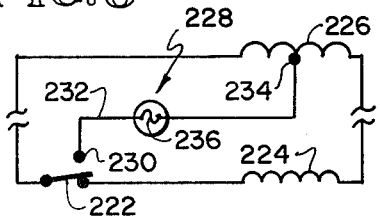

The switches 74–108 are, in the embodiments of FIGS. 2, 5 and 6, of the single pole, double throw type and comprise a first or common terminal 120, a second terminal 122, a switch element 124 normally closing the terminals 120, 122 and a third normally unused terminal 126. As is apparent from FIG. 2, the switches 74–108 are wired such that the second terminal of one switch is connected to the common terminal of the next adjacent switch.

Figure 3:
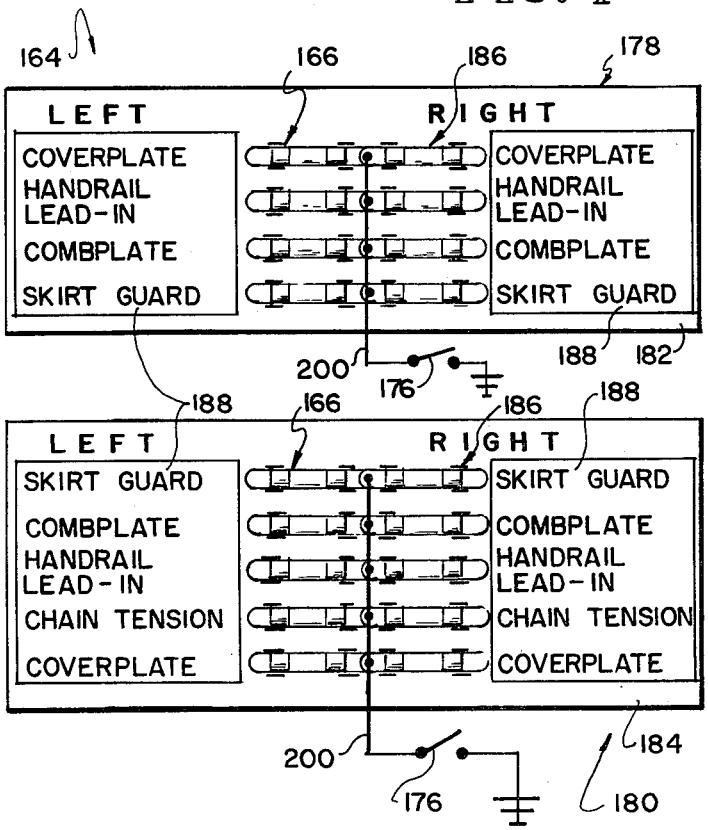
FIG. 3 is a more detailed view of the troubleshooting panel of the invention.

Referring to FIGS. 1–3, it is a convention of the escalator art to name the left and right sides when standing at the bottom of the escalator 10 and looking at the top. Accordingly, only the left side of the escalator 10 is illustrated in FIG. 1. Although the switch 74 is shown as the left coverplate switch, the switch 76 as the right coverplate switch and the like, it should be apparent that any desired arrangement of the switches may be effected. It should also be apparent that various of the switches 74–108 may be eliminated or additional switches and indicators provided as desired.

The motor starting switch network 110 comprises an input terminal 128 connected to the switches 74–108 having a lead 130 connected thereto having therein a lower inspection switch 132. The lead 130 is connected to the common terminal of a momentary contact, key operated switch 134 located at the upper end of the escalator 10 for switch closing movement toward a first lead 136 to energize the up relay coil U and toward a second lead 138 to energize the down relay coil D. The lead 136 is connected to a wire 140 which is connected to a lead 142 having a relay switch assembly U5 therein which is connected by a lead 144 through a switch element 146 of an upper inspection switch 148 to a lead 150 connected to the common terminal of the key operated switch 134. When the key operated switch 134 is moved in switch closed relation with the lead 136, the up relay coil U is energized which closes the relay switch assemblies U1, U2, U3, U5 and opens the normally closed relay switch assembly U4. The switch assembly U5 is accordingly a self holding contact which acts to energize the up relay U through the wires 150, 144, 142 and the switch element 146 after the monentary contact switch 134 reopens. It will accordingly be apparent that FIG. 2 illustrates the circuit 30 in a configuration to drive the endless stair 12 in an up direction.

The second lead 138 is connected to a lead 152 having a relay switch assembly D5 therein. When the motor 20 is off and the key operated switch 134 is moved in switch closing relation with the second lead 138, a circuit is completed through the leads 138, 114 and the normally closed relay switch assembly U4 to energize the down relay coil D thereby closing the relay switch assemblies D1, D2, D3, D5 and opening the normally closed relay switch assembly D4. The switch assembly D5 is accordingly a self holding contact which acts to energize the down relay coil D through the lead 150, the switch element 146, the lead 144, the lead 152 and the lead 114.

The motor starting switch network 110 also comprises a second momentary contact, key operated switch 154 located at the lower end of the escalator 10 for switch closing movement toward the lead 140 and a switch element 156 for energizing the up relay coil U to drive the motor 20 and the endless stair 12 in an up direction. The key operated switch 154 is also movable in switch closing direction toward a lead 158 having a switch element 160 therein connected to the second lead 138. The key operated switch 154 is accordingly operable to energize the down relay coil D. The switch contacts 146, 156, 160 are ganged together by a suitable ganging element 162 comprising part of the upper inspection switch 148.

As heretofore described, the escalator 10 and power circuit 30 will be recognized by those skilled in the art as an escalator system of conventional design.

In accordance with the principles of this invention, there is provided an indicator system 164 for designating which of the switches 74–108 has opened in response to machine malfunction, unsafe condition or an inappropriate placement of any of the switches 74–108. The indicating system 164 comprises an indicator for each of the switches 74–108 and has a number of operating characteristics. First, the indicating system 164 does not interfere in any manner with functioning of the switches 74–108 in the sense that each of the switches 74–108 retains the capability of shutting off the motor 20 upon opening of any of the switches. Accordingly, the indicators of the indicating system 164 do not provide a permanent electrical path around any of the switches 74–108 that could act as a bypass to continue energization of either of the relay coils U, D. Second, each indicator of the system 164 has a first or normal appearance when its associated switch is closed and a second or distinctly different appearance after its associated switch opens. To these ends, the indicating system 64 comprises a conductive element in circuit with each of the switches 74–108 in the switch open position which is rendered non-conductive and distinctly different in appearance upon switch opening. More specifically, the conductive element is rendered non-conductive and distinctly different in appearance upon the opening of its associated switch and the passage of an electrical overload therethrough.

In the embodiment of FIG. 2, the indicating system 164 comprises a fuse 166 for each of the switches 74–108 comprising a conductive element 168 inside a non-opaque housing or envelope 170 and connected by a lead 172 to the third or normally unused terminal 126 and by a lead 174 having a disconnect switch 176 therein to ground. When any one of the switches 74–108 opens in response to its monitored event, the energized relay coil U drops out thereby opening the relay switch assemblies U1, U2, U3, U5 and closing the relay switch assembly U4 thereby stopping the motor 20. As soon as the switch element 124 contacts the terminal 126, a circuit is completed through the fuse 166 to ground. Because the voltage in the lead 70 is quite high, usually 220 volts, and the circuit including the fuse 166 is grounded, the amperage through the fuse 166 is quite high and the fuse 166 blows quickly. It should be noted, however, that the electrical overload which blows the fuse 166 is lower than the normal electrical load carried by the switches 74–108 because of the existance of the fuse 72. When a repairman arrives at the escalator 10, an inspection of the indicating system 164 will designate which switch caused the machine stoppage thereby pinpointing the problem.

Although the fuse may be of any suitable type, it is preferred that it incorporates some technique other than merely burning the conductive element in two to provide a distinctly different appearance. For example, one type of available fuse is known as a slow-blow fuse and incorporates what appears to be a string wound about part of the conductive element. When the fuse blows, the string turns brown thereby giving a dramatically different appearance. One manufacturer of such fuses is Buss under the model designation MDL. Another type fuse which is dramatically different in appearance after blowing is of a ceramic variety wherein the ceramic material becomes dark after the fuse blows. A further suitable fuse of this type comprises a flag element similar to that used in the telephone industry.

It is within the realm of possibility that opening of one of the switches 74–108 and the completion of a circuit through one of the fuses 166 may create a sufficient current flow in the lead 70 to blow the fuse 72. This can be avoided by the selection of the fuse 166 to be substantially lower in amperage rating than the fuse 72. It is, of course, not difficult to select an ampere rating for the fuse 166 that will cause it to blow because the full voltage of the winding 68 is applied to the circuit including the fuse 166 and the resistance of this circuit is very small. In practice, a 0.1 ampere fuse has worked satisfactorily. In the alternative, the fuse 72 may be placed in series with the switches 74–108 between the switch 108 and the inlet terminal 128 of the switch network 110.

The function of the switch 176 is to deactivate the indicating system 164. This may be advantageous during the installation of the escalator 10 when many of the escalator systems are being adjusted because many fuses will be unnecessarily blown during this adjustment period. In the alternative, the installer may merely allow the fuses to blow and replace all of the blown fuses after installation and adjustment operations are complete. In the alternative, the installer may merely remove the fuses 166 from the indicating system 164 during this installation period.

Figure 4:
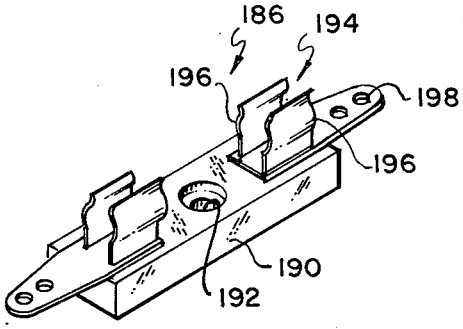
FIG. 4 is an isometric view of the fuse holder illustrated in FIG. 3.

Referring to FIGS. 3 and 4, the indicating system 164 is illustrated in substantially greater detail. Because the escalator 10 has switches at the lower end thereof and at the upper end thereof, it is preferred to provide a first or upper indicating panel 178 in the control panel adjacent the upper end of the escalator 10 and a second or lower indicating panel 180 in the control panel adjacent the lower escalator end. The panels 178, 180 each comprise a board 182, 184 which is preferably of insulating material. A plurality of fuse holders 186 are attached to the boards 182, 184 in any convenient fashion. In a typical escalator 10, there are four switches on each side of the escalator at the top thereof so that the panel 178 includes eight fuses 166 and eight fuse holders 186. The lower end of the escalator 10 typically has five switches on each side thereof so that the panel 180 preferably has ten fuses 166 and ten fuse holders 186. Suitable labels 188 are preferably adhesively affixed to the boards 182, 184 to designate which of the switches 74–108 is associated with each of the fuses 166.

As shown best in FIG. 4, the fuse holders 186 comprise an insulating block 190 having an opening 192 therethrough for receiving a screw or bolt to attach the fuse holders 186 to the boards 182, 184. On each end of the block 190 is fuse clip 194 comprising a pair of upstanding ears 196 for grasping the conductive ends of the fuse 166 and a laterally extending leg 198 to which suitable wires or leads may be attached.

As shown best in FIG. 3, the fuse holders 186 are are arranged in vertically spaced pairs with the laterally extending legs 198 overlapping and in electrical contact. A suitable ground wire 200 is connected, as by soldering or the like, to the overlapped ears and extends to the disconnect switches 176, 176'.

Referring to FIG. 5, there is illustrated another embodiment of the invention. An indicator 202 is associated with each of a plurality of normally closed single pole, double throw switches 204 comprising a first or common terminal 206, a second terminal 208 normally closed by a switch element 210 and a third or normally unused terminal 212. A lead 214 is connected to the terminal 212 and has therein a bulb 216 comprising a conductive element 218 connected to ground. When the event monitored by the switch 204 occurs, the switch 204 opens to drop the energized relay coil and close the circuit through the bulb 216. The bulb 216 is selected to fail substantially immediately upon closing of the contact 212. Although the mere failure of the conductive element 218 may be relied upon to provide a distinctive appearance, it is preferred that the envelope 220 discolor, craze, crack, bulge or otherwise provide a dramatically different appearance between blown and unblown bulbs. There is, of course, no difficulty in selecting a bulb that will blow because the full voltage of the winding 68 is applied thereto.

Referring to FIG. 6, there is illustrated another embodiment of the invention in which normally closed switch 222 is in circuit with a relay coil 224 and a low voltage transformer winding 226. An indicator 228 is connected between a normally unused terminal 230 of the single pole, double throw switch 222. The indicator 228 comprises a lead 232 connected between the terminal 230 and an intermediate tap 234 of the winding 226 and contains therein a conductive element 236 which may be a fuse as illustrated or a bulb. The advantage of the indicator 228 occurs in relatively high voltage relay circuits where the closing of the terminal 230 may initiate contact arcing. When the terminal 230 is closed, it is apparent that only half of the voltage passes through the conductive element 236 rather than all of the voltage of the transformer if the lead 232 were grounded.

Figure 7:
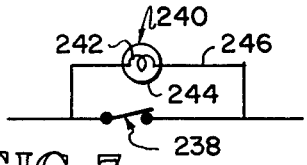

Referring to FIG. 7, there is illustrated another embodiment of the invention comprising a normally closed switch 238 for monitoring a function of its associated machine. In parallel with the switch 238 is an indicator 240 illustrated as a bulb having a conductive element 242 therein housed in an envelope 244 and connected by a lead 246 in parallel with the switch 238. It will be apparent that the embodiment of FIG. 7 is particularly desirable for use with machines that do not normally incorporate switches of the double throw variety. It will also be noted that the conductive element 242 fails at an electrical overload which is equal to or less than the normal electrical load of the relay circuit. Some care must be taken in selecting the bulb comprising the indicator 240 because it is in the line rather than in a grounded circuit. Such selection is within the ability of those skilled in the art.

Figure 8:
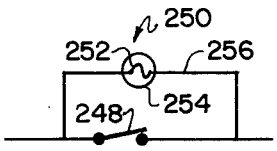

A similar embodiment is illustrated in FIG. 8 where a normally closed switch 248 is associated with an indicator 250 comprising a fuse having a conductive element 252 disposed in a housing or envelope 254 and connected by a lead 256 in parallel with the switch 248.

It will be apparent that the bulbs used in the indicators of this invention may be of the filament type or the inert gas type.

Although the invention has been described in its preferred forms with a certain degree of particularity, it is understood that the present disclosure of the preferred forms is only by way of example and that numerous changes in the details of construction and the combination and arrangement of parts may be resorted to without departing from the spirit and scope of the invention as hereinafter claimed.

I claim:

1. A machine comprising an electric motor and a circuit for energizing the motor;

a multiplicity of normally closed switches in the circuit for monitoring the operation of the machine any one of which opens in response to the occurrence of an event to shut off the motor and which are capable of reclosing in response to the cessation of the event to place the motor in a condition to restart;

means enabling restarting of the motor upon reclosing of an opened switch; and means for indicating which of the multiplicity of switches has opened regardless of whether the open switch has reclosed, including a multiplicity of indicators each of which comprises conductive means in circuit with an associated one of the switches in the switch open position which is rendered nonconductive upon opening of its associated switch and upon passage of a given electrical load therethrough and means rendered distinctly different in appearance upon passage of the given electrical load through the conductive means;

each associated switch being arranged in circuit with its associated conductive means for delivering the given electrical load therethrough upon switch opening.

2. The machine of claim 1 wherein the motor energizing circuit includes the conductive means associated with an opened switch.

3. The machine of claim 2 wherein each of the switches comprises a pair of normally closed normally energized contacts, a normally deenergized contact and means energizing the normally deenergized contact upon opening movement of the normally closed contacts, the conductive element being in circuit with the normally deenergized contact.

4. The machine of claim 3 wherein the conductive element is connected between the normally deenergized contact and ground.

5. The machine of claim 4 wherein the conductive means is a fuse.

6. The machine of claim 5 wherein the means rendered distinctly different in appearance of the fuse incorporates means other than the conducted means which change visual appearance upon interruption of the conductive means.

7. The machine of claim 4 wherein the conductive means is a bulb.

8. The machine of claim 7 wherein the means rendered distinctly different in appearance of the bulb incorporates means other than the conductive means which changes visual appearance upon interruption of the conductive means.

9. The machine of claim 7 wherein the bulb is of the inert gas filled type.

10. The machine of claim 2 wherein the conductive means is in parallel with its associated switch.

11. The machine of claim 10 wherein the conductive means is a fuse.

12. The machine of claim 11 wherein the means rendered distinctly different in appearance of the fuse incorporates means other than the conductive means which changes visual appearance upon interruption of the conductive means.

13. The machine of claim 11 wherein the means rendered distinctly different in appearance is the conductive means.

14. The machine of claim 10 wherein the responsive device is a bulb.

15. The machine of claim 14 wherein the means rendered distinctly different in appearance of the bulb incorporates means other than the conductive means which changes visual appearance upon interruption of the conductive means.

16. The machine of claim 2 wherein the machine is an escalator.

17. A machine comprising an electric motor and a circuit for energizing the motor;

a multiplicity of normally closed switches in the circuit for monitoring the operation of the machine any one of which opens in response to the occurrence of an event to shut off the motor and which are capable of reclosing in response to the cessation of the event to place the motor in a condition to restart;

means enabling restarting of the motor upon reclosing of any opened switch; and means for indicating which of the multiplicity of switches has opened regardless of whether the opened switch has reclosed, including a multiplicity of indicators each of which comprises a conductive element in circuit with an associated one of the switches in the switch open position which is rendered nonconductive upon opening of its associated switch and upon passage of a given electrical load therethrough, the conductive element having the characteristic of being rendered distinctly different in appearance upon passage of the given electrical load through the conductive element;

each switch being arranged in circuit with its associated conductive element for delivering the given electrical load therethrough upon the switch opening.

18. The machine of claim 17 wherein the motor energizing circuit includes the conductive element associated with an opened switch.

* * * * *